United States Patent [19]

Ogawa

[11] Patent Number: 5,003,229

[45] Date of Patent: Mar. 26, 1991

[54] FLASHING DEVICE

[75] Inventor: Kimiaki Ogawa, Tokyo, Japan

[73] Assignee: Asahi Kogaku Kogyo Kabushiki Kaisha, Tokyo, Japan

[21] Appl. No.: 540,385

[22] Filed: Jun. 19, 1990

Related U.S. Application Data

[63] Continuation of Ser. No. 305,128, Feb. 2, 1989, abandoned.

[30] Foreign Application Priority Data

Feb. 13, 1988 [JP] Japan ..... 63-17833[U]

[51] Int. Cl.[5] ..... H05B 41/00

[52] U.S. Cl. ..... 315/240; 315/241 P; 354/149.11

[58] Field of Search ..... 315/240, 241 R, 241 P; 354/126, 145.1, 149.11, 484; 362/3

[56] References Cited

U.S. PATENT DOCUMENTS 4,310,785 1/1982 Iwata ..... 315/241 P 4,881,013 11/1989 Kataoka et al. ..... 315/241 P

*Primary Examiner*—Robert J. Pascal

*Attorney, Agent, or Firm*—Sughrue, Mion, Zinn, Macpeak & Seas

[57] ABSTRACT

A flashing device comprises a rechargeable power supply, a voltage-raising circuit for producing a high voltage from an output voltage of the power supply, a condenser for storing the high voltage, a light-emitting tube for emitting light for a short moment using energy stored in the condenser, an emission control circuit for triggering light emission of the light-emitting tube, a charging circuit including a diode for allowing a current flow from the condenser to the power supply, and a changeover switch for discharging over connection of the power supply to the voltage-raising circuit or to the charging circuit.

5 Claims, 1 Drawing Sheet

FLASHING DEVICE

This is a Continuation of Application No. 07/305,128 filed Feb. 2, 1989 now abandoned.

BACKGROUND OF THE INVENTION

The present invention relates to a flashing device used in a camera, etc., and more specifically, relates to a flashing device in which stored energy for next light emission is not lost wastefully.

FIG. 1 is a circuit diagram showing the basic constitution of a typical flashing device which is used in a camera, etc.

In this figure, when a battery switch (strobo switch) 12 is closed, a current from a battery (secondary battery) 10 is provided through the battery switch 12 to a voltage-raising circuit 14. A high voltage appearing at an output of the voltage-raising circuit, which is about 300 V, is used to charge a condenser 16 and also applied to electrodes of a light-emitting tube 18. A discharge tube in which xenon gas, etc. is sealed, is employed as the light-emitting tube 18.

Furthermore, an emission control circuit 20 is provided in the above flashing device. When a trigger switch 22, which is linked with a release button, etc. of a camera, is turned on, a pulse signal is provided from the emission control circuit to a trigger electrode 18*a* of the light-emitting tube 18.

The flashing device is placed in its waiting state by having turned on the battery switch 12 prior to its actual use. When the light-emitting tube 18 is triggered, in this waiting state, by the trigger pulse signal which is produced in response to the turning-on of the trigger switch 22, it emits light for a short moment. This light emission is performed by using energy previously stored in the condenser 16. After the light emission the condenser 16 is charged again.

In this case, since the condenser 16 is automatically recharged, the electric charge remains when, after completion of use of the flashing device, the battery switch 12 is turned off. This remaining energy in the condenser 16 is lost (discharged) with a lapse of time and it scarcely contributes to the following light emission. This means a waste of energy, that is, a waste of the energy originally stored in the battery.

SUMMARY OF THE INVENTION

An object of the present invention is to provide a flashing device which can effectively utilize the energy remaining in the device after its use.

A flashing device according to the present invention comprises: rechargeable power supply means such as a secondary battery; voltage-raising means for producing a high voltage from an output voltage of the power supply means; condenser means for storing the high voltage; light-emitting means for emitting light for a short moment using energy stored in the condenser means; emission control means for triggering light emission of the light-emitting means; charging means for allowing a current flow from the condenser means to the power supply means; and switch means for changeover connection of the power supply means to the voltage-raising circuit or to the charging circuit.

DETAILED DESCRIPTION OF THE PREFERRED EMBODIMENT

Figure 1:
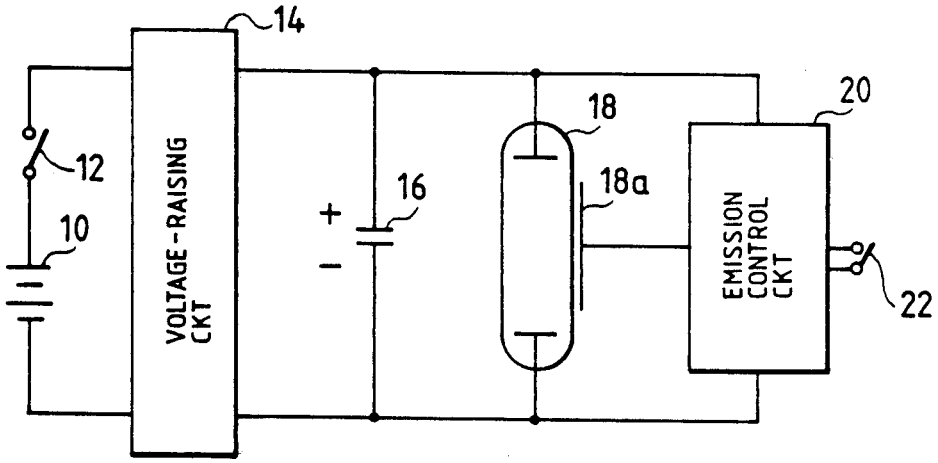
FIG. 1 PRIOR ART
FIG. 1 is a circuit diagram, partly a block diagram, of a conventional flashing device.
Figure 2:
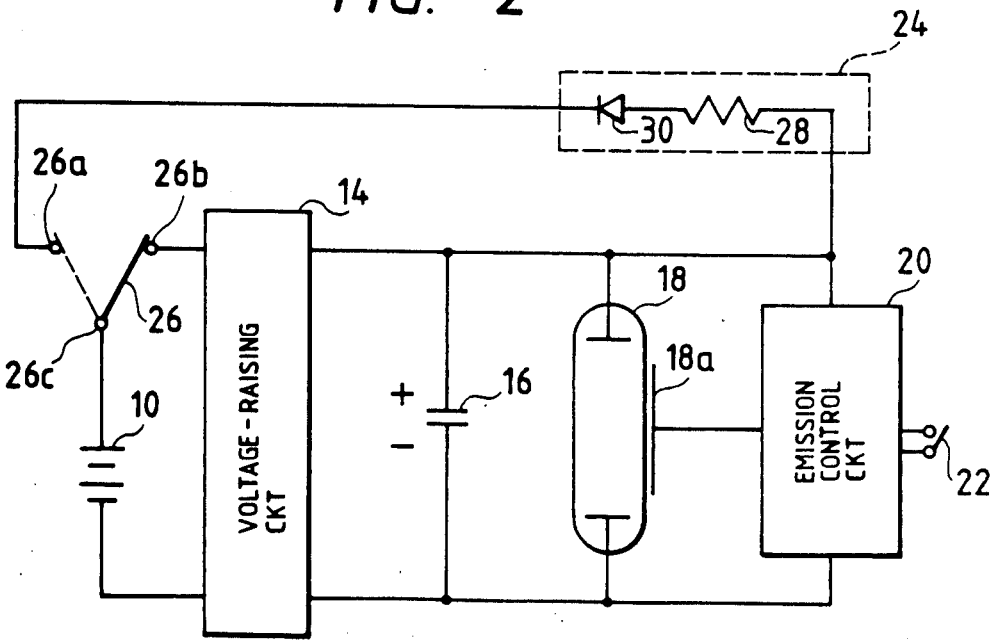
FIG. 2 is a circuit diagram, partly a block diagram, of a flashing device according to an embodiment of the present invention.

FIG. 2 shows a flashing device according to an embodiment of the present invention, where parts corresponding to those in FIG. 1 are designated by the same reference numerals and the explanation for those will be omitted.

In this flashing device, a charging circuit 24 is connected to a condenser 16 and a changeover switch 26 is employed in place of the switch 12 in FIG. 1. By means of this changeover switch 26, a battery 10 is selectively connected to the voltage-raising circuit or to the charging circuit 24.

The charging circuit 24 is a series circuit of a resistor 28 and a diode 30. A positive electrode of the condenser 16 is connected through the resistor 28 and the diode 30 to a fixed terminal 26*a* of the changeover switch 26. The diode 30 is arranged so as to allow a current flow from the resistor 28 to the changeover switch 26. Another fixed terminal 26*b* and a terminal 26*c* of the changeover switch are connected to the voltage-raising circuit 14 and the battery 10, respectively.

The operation of this flashing device proceeds as follows. If the changeover switch 26 is changed over to the terminal 26*b* as indicated by a solid line in FIG. 2, the condenser 16 is charged and the device is made to be in its waiting state. When a trigger switch 22 is turned on in this state, a light-emitting tube 18 emits light and then the condenser 16 is automatically recharged.

On the other hand, if e.g., in not using the device, the changeover switch 26 is changed over to the terminal 26*a* as indicated by a dashed line in FIG. 2, the high voltage stored in the condenser 16 is applied through the resistor 28 and the diode 30 to the battery 10 so as to recharge it.

When the voltage of the condenser 16 becomes lower than that of the battery 10, the current flow to the battery 10 is automatically stopped and, at the same time, by virtue of the diode 30 an opposite current flow from the battery 10 to the condenser 16 is prohibited.

If the changeover switch 26 is again changed over to the terminal 26*b* as indicated by the solid line in FIG. 2 in a following use of the device, the condenser 16 is recharged and the device is made to be in its waiting state for a light emission.

With the above-described flashing device, by changing over the changeover switch, the same operation as in the conventional flashing device can be performed in its actual use and additionally the energy remaining in the condenser can be returned to the battery. The flashing device of the invention has an advantage that the energy in the battery can be saved, in other words, can be effectively utilized.

What is claimed is:

1. A flashing device, comprising:

power supply means which is rechargeable;

voltage-raising means for producing a high voltage from an output voltage of said power supply means;

condenser means for storing said high voltage;

light-emitting means for emitting light using energy stored in said condenser means;

emission control means for triggering light emission of said light-emitting means; and charging means for returning said high voltage stored in said condenser means to said power supply means when said flashing device is not used.

2. A flashing device as claimed in claim 1, wherein said power supply means is a secondary battery.

3. A flashing device as claimed in claim 1, wherein said light-emitting means is a light-emitting tube.

4. A flashing device as claimed in claim 1, wherein said charging means comprises a series connection of a resistor and a diode.

5. A flashing device as claimed in claim 1 further comprising switch means for changing over connection of said power supply means to said voltage-raising means or to said charging means.

* * * * *